US010941925B1

(12) United States Patent
Tan et al.

(10) Patent No.: US 10,941,925 B1
(45) Date of Patent: Mar. 9, 2021

(54) LAMP

(71) Applicant: YICHANG JIANGJING OPTOELECTRONIC CO., LTD., Yichang (CN)

(72) Inventors: Ming Tan, Yichang (CN); Yibo Xu, Yichang (CN)

(73) Assignee: YICHANG JIANGJING OPTOELECTRONIC CO., LTD., Yichang (CN)

( * ) Notice: Subject to any disclaimer, the term of this patent is extended or adjusted under 35 U.S.C. 154(b) by 0 days.

(21) Appl. No.: 17/009,807

(22) Filed: Sep. 2, 2020

(51) Int. Cl.
*F21V 21/30* (2006.01)
*F21V 21/088* (2006.01)

(52) U.S. Cl.
CPC ..... *F21V 21/30* (2013.01); *F21V 21/088* (2013.01)

(58) Field of Classification Search
CPC ..... F21V 21/30; F21V 21/088; F21V 21/14; F21V 21/041; F21V 21/042; F21V 21/047; F21V 21/048; F21V 21/049
See application file for complete search history.

(56) References Cited

U.S. PATENT DOCUMENTS

2013/0215324 A1* 8/2013 Manning ..... F21V 21/30 362/249.07
2015/0338084 A1* 11/2015 Ryder ..... F21V 21/047 362/287
2017/0356632 A1* 12/2017 Rao ..... F21V 21/048

* cited by examiner

*Primary Examiner* — Y M. Quach Lee

(57) ABSTRACT

The present disclosure provides a convenient-to-replace lamp, including a bracket, a lamp body, and a locking assembly. The bracket is enclosed to form an accommodation portion. The bracket includes a hollow plate. The hollow plate includes a first flat plate and a second flat plate, where the first flat plate and the second flat plate are symmetrically disposed. A first vertical plate is convexly disposed on the surface of the first flat plate, and the first vertical plate is connected with one side of the first flat plate close to the second flat plate. A second vertical plate is convexly disposed on the surface of the second flat plate, and the second vertical plate is connected with one side of the second flat plate close to the first flat plate. The first vertical plate and the second vertical plate are oppositely disposed.

11 Claims, 7 Drawing Sheets

LAMP

TECHNICAL FIELD

The present disclosure relates to a technical field of LEDs, in particular to a lamp convenient to replace.

BACKGROUND

At present, a conventional lamp tray (lamp) is basically fixed on a ceiling keel through a bracket or a fixing frame, which is inconvenient to replace. When the lamp needs to be replaced to a new one, the bracket or the fixing frame needs to be detached at a same time, which is complicated, time consuming, and inefficient, resulting in expensive manual disassembly costs and damage to the structural parts if operation of disassembling is improper.

In view of this, overcoming deficiencies of prior art products is a problem to be solved in this art.

SUMMARY

A main technical problem of the present disclosure is to provide a lamp convenient to replace, including a bracket and a lamp body, and the bracket and the lamp body are split-type. When the lamp body is replaced, the lamp body is detached from the bracket, a disassembly process of which is simple and convenient. Thus, disassembly efficiency is improved and maintenance cost is decreased.

In order to solve above technical problem, the present disclosure provides a lamp, including a bracket, a lamp body, and at least one locking assembly. The bracket is enclosed to form an accommodation portion, the accommodation portion is configured to accommodate the lamp body.

The bracket includes a hollow plate. The hollow plate includes a first flat plate and a second flat plate, where the first flat plate and the second flat plate are symmetrically disposed. A first vertical plate is convexly disposed on a surface of the first flat plate, and the first vertical plate is connected with one side of the first flat plate close to the second flat plate. A second vertical plate is convexly disposed on a surface of the second flat plate, and the second vertical plate is connected with one side of the second flat plate close to the first flat plate. The first vertical plate and the second vertical plate are oppositely disposed. A first open groove is disposed on the first vertical plate, and a second open groove is disposed on the second vertical plate. A first clamping shaft is disposed on one side of the lamp body, a second clamping shaft is disposed on another side of the lamp body. The first clamping shaft is clamped into the first open groove to be rotatably and detachably connected with the first vertical plate, the second clamping shaft is clamped into the second open groove to be rotatably and detachably connected with the second vertical plate, so that the lamp body is rotatably and detachably connected with the bracket.

The locking assembly limits the lamp body to rotate relative to the bracket when the lamp body is rotated into the accommodation portion.

Furthermore, a sliding groove is disposed on the first vertical plate. The locking assembly includes a folding plate, clamping tables, and a clamping support. The clamping tables are convexly disposed on one side of the folding plate, and the clamping support is convexly disposed on another side of the folding plate. Limiting portions are respectively disposed on one end of each of the clamping tables distal to the folding plate, the clamping tables pass through the sliding groove so that the locking assembly slides along the sliding groove. The limiting portions are configured to limit the clamping tables to slide out of the sling groove. A third open groove is disposed on one side of the lamp body. When the body lamp rotates into the accommodation portion, the clamping support slides into the third open groove along a direction of the sliding groove to limit the lamp body to rotate relative to the bracket.

Furthermore, the hollow plate includes a third flat plate and a fourth flat plate, where the third flat plate and the fourth flat plate are symmetrically disposed. The first flat plate, the third flat plate, the second flat plate, and the fourth flat plate are connected end to end to form the hollow plate. A surface of the third flat plate is connected with two connecting overlapping edges. One end of each of the two connecting overlapping edges extends out of the third flat plate in a direction of the third flat plate distal from the fourth flat plate. Two overlapping rotating sheets are rotatably connected with a surface of the fourth flat plate, when the overlapping rotating sheets rotate relative to the third flat plate in a predetermined angle, one end of each of the overlapping rotating sheets extends out of the fourth flat plate in a direction of the fourth flat plate distal from the third flat plate.

Furthermore, the first open groove, the second open groove, and the third open groove are U-shaped grooves. A width of the first open groove is equal to a diameter of the first clamping shaft, and a width of the second open groove is equal to a diameter of the second clamping shaft.

Furthermore, an upper end limiting plate is convexly disposed on a surface of the one side of the folding plate, and the upper end limiting plate is attached to a surface of one side of the first flat plate distal to the sliding groove.

Furthermore, an upper end pushing plate is disposed on one side of the upper limiting plate, the upper end pushing plate is perpendicular to the first vertical plate, and an edge of the upper end pushing plate is a curve.

Furthermore, at least two clamping tables are disposed on the folding plate. The clamping tables disposed on the folding plate are disposed at intervals. An arrangement direction of the clamping tables disposed on the folding plate is same as an extending direction of the sliding groove.

Furthermore, the limiting portions are fixing bolts. Threaded holes are respectively disposed on one end of each of the clamping tables. The fixing bolts are screwed into the threaded holes to be connected with the clamping tables.

Furthermore, the clamping tables are any one of a cylinder, a square column, and a prism.

Furthermore, a control box is disposed on one side of the lamp body to control the lamp body. The control box is connected with the lamp body by a screw.

Compared with the prior art, the present disclosure provides the lamp, including the bracket, the lamp body, and at least one locking assembly. The bracket is enclosed to form the accommodation portion, the accommodation portion is configured to accommodate the lamp body. The bracket includes the hollow plate. The hollow plate includes the first flat plate and the second flat plate, where the first flat plate and the second flat plate are symmetrically disposed. The first vertical plate is convexly disposed on the surface of the first flat plate, and the first vertical plate is connected with one side of the first flat plate close to the second flat plate. The second vertical plate is convexly disposed on the surface of the second flat plate, and the second vertical plate is connected with one side of the second flat plate close to the first flat plate. The first vertical plate and the second vertical plate are oppositely disposed. The first open groove is disposed on the first vertical plate, and the second open groove is disposed on the second vertical plate. A first clamping shaft is disposed on one side of the lamp body, a second clamping shaft is disposed on another side of the lamp body. The first clamping shaft is clamped into the first open groove to be rotatably and detachably connected with the first vertical plate, the second clamping shaft is clamped into the second open groove to be rotatably and detachably connected with the second vertical plate, so that the lamp body is rotatably and detachably connected with the bracket. The locking assembly limits the lamp body to rotate relative to the bracket when the lamp body is rotated into the accommodation portion. The lamp includes the bracket and the lamp body, and the bracket and the lamp body are split-type. When the lamp body is replaced, the lamp body is detached from the bracket, the disassembly process of which is simple and convenient. Thus, the disassembly efficiency is improved and the maintenance cost is decreased.

BRIEF DESCRIPTION OF DRAWINGS

In order to more clearly illustrate the technical solutions of embodiments of the present disclosure, reference is made to the accompanying drawings, which are to be used in connection with the embodiments or the prior art. In particular, it will be obvious that the drawings in the following description are merely some examples of the present disclosure, and other drawings may be obtained by those skilled in the art without creative efforts according to the structures illustrated in these drawings.

DETAILED DESCRIPTION

Figure 1:
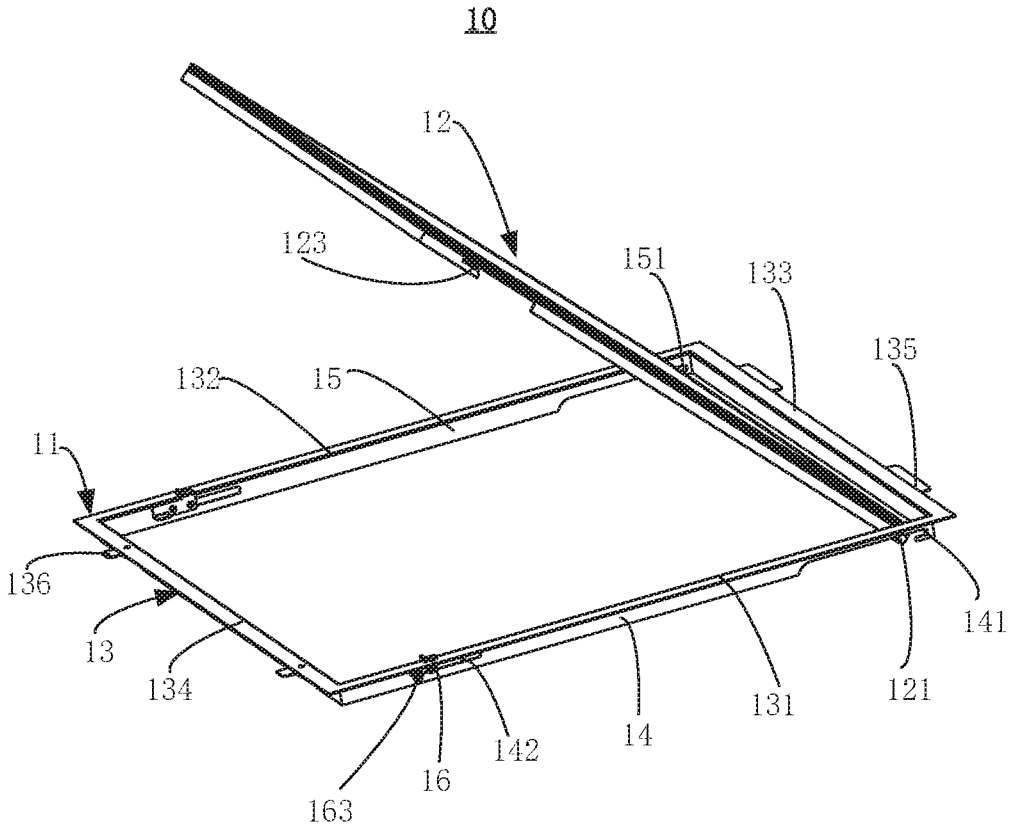
FIG. 1 is a structural schematic diagram of a lamp according to one embodiment of the present disclosure.

The technical solutions in the embodiments of the present disclosure are clearly and completely described in conjunction with the accompanying drawings in the embodiments of the present disclosure, and obviously, the described embodiments are merely a part of the embodiments of the present disclosure and not all embodiments. All other embodiments obtained by those skilled in the art based on the embodiments herein do not fall within scopes of the present disclosure.

In the description of the present disclosure, it should be understood that, orientations or positional relationships indicated by terms "center", "longitudinal", "lateral", "length", "width", "thickness", "upper", "lower", "front", "rear", "left", "right", "vertical", "horizontal", "top", "bottom", "inner", "outer", etc., are based on orientations or positional relationships shown in the drawings, but are merely for easily describing the present disclosure and simplifying description, rather than to indicate or imply that the indicated device or element must have a particular orientation, construct and operate in a particular orientation, and therefore not to be construed as a limitation on the present disclosure. Furthermore, terms "first" and "second" are used for descriptive purposes only and are not to be construed as indicating or implying relative importance or implicitly indicating the number of technical features indicated. Thus, features defining "first" and "second" may explicitly or implicitly include one or more features. In the description of the present disclosure, a meaning of "a plurality of" is two or more unless specifically defined otherwise.

In the present disclosure, "exemplary" is used for indicating "serving as an example, instance, or illustration". Any embodiment described herein as "exemplary" is not necessarily to be construed as preferred or advantageous over other embodiments. Following description is presented to enable those skilled in the art to make and use the present disclosure. In the following description, details are set forth for purposes of explanation. It should be understood that those skilled in the art recognize that the present disclosure may be practiced without these specific details. In other embodiments, well-known structures and processes are not described in details to avoid unnecessarily obscuring the description of the present disclosure. Thus, the present disclosure is not intended to be limited to the embodiments shown, but is to be accorded widest scopes consistent with principles and features disclosed herein.

Figure 2:
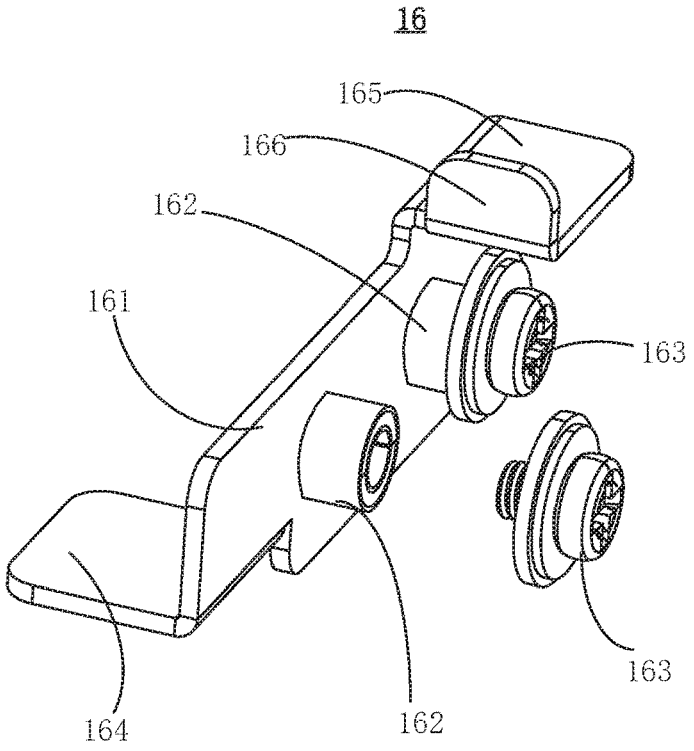
FIG. 2 is an exploded structural schematic diagram of a locking assembly of the lamp according to one embodiment of the present disclosure.
Figure 3:
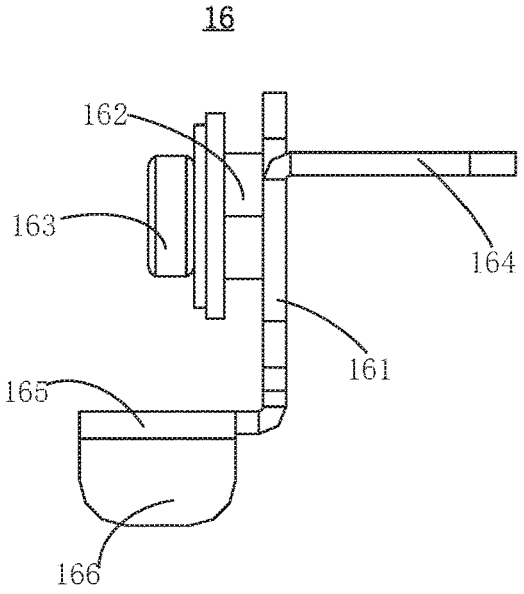
FIG. 3 is an exploded structural schematic diagram of a side surface of the locking assembly of the lamp according to one embodiment of the present disclosure.
Figure 4:
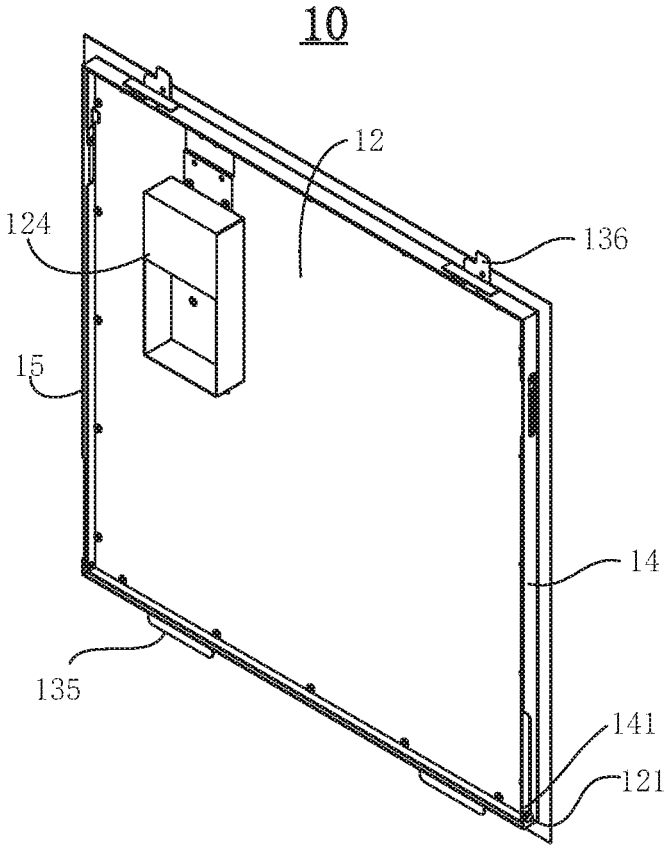
FIG. 4 is a structural schematic diagram of a back surface of the lamp where a lamp body is embedded into a bracket according to one embodiment of the present disclosure.
Figure 5:
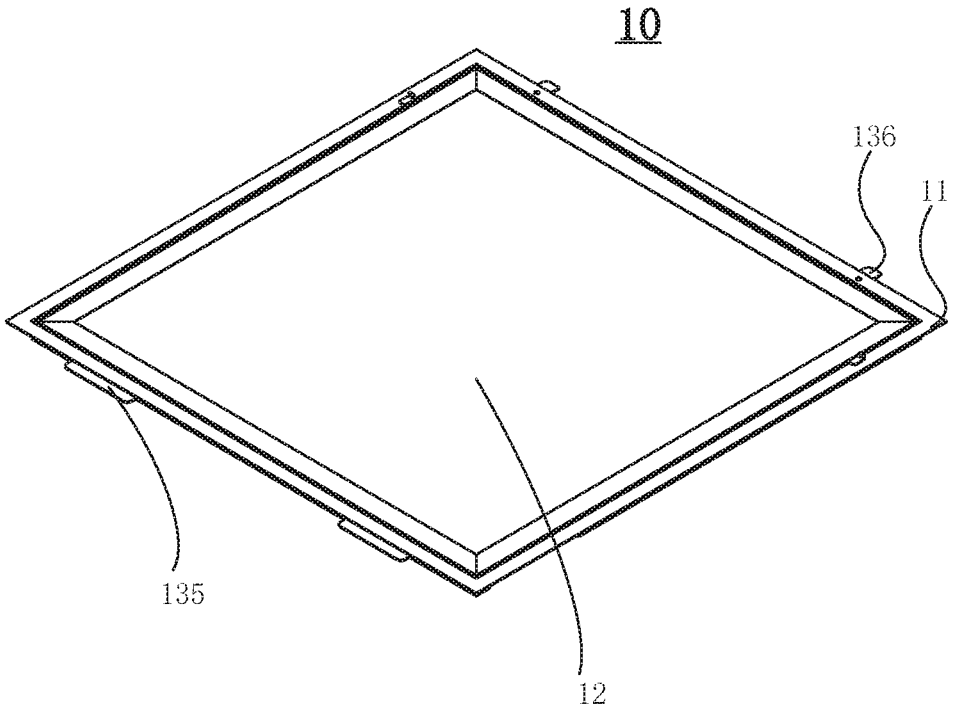
FIG. 5 is a structural schematic diagram of a front surface of the lamp where the lamp body is embedded into the bracket according to one embodiment of the present disclosure.
Figure 6:
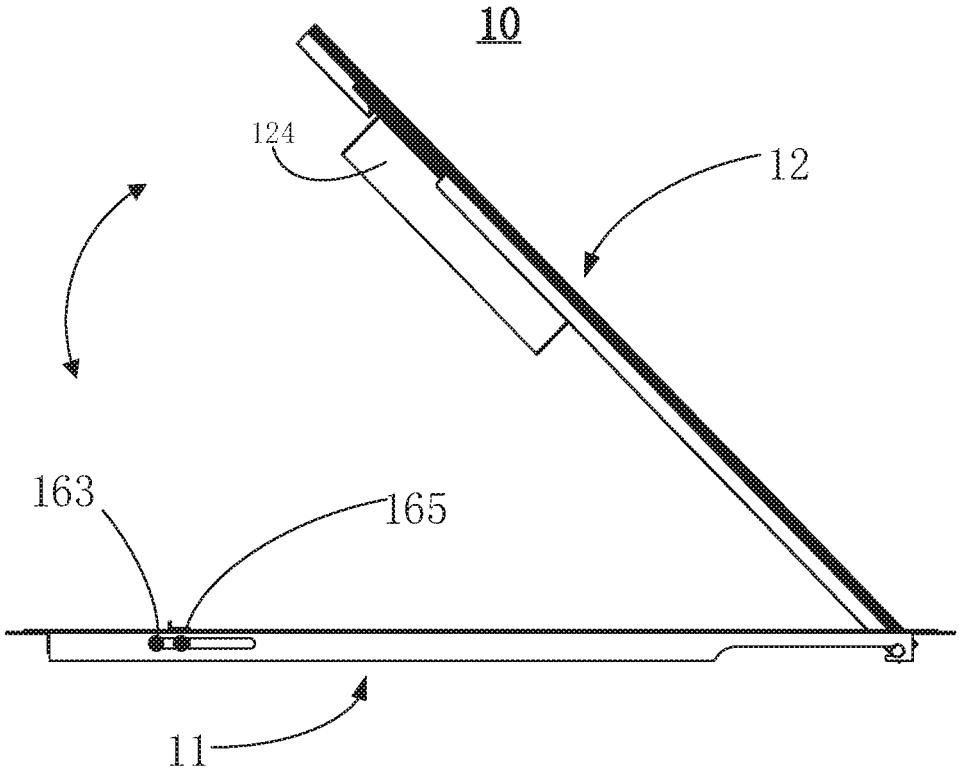
FIG. 6 is a structural schematic diagram of a side surface of the lamp where the lamp body is unfolded relative to the bracket according to one embodiment of the present disclosure.
Figure 7:
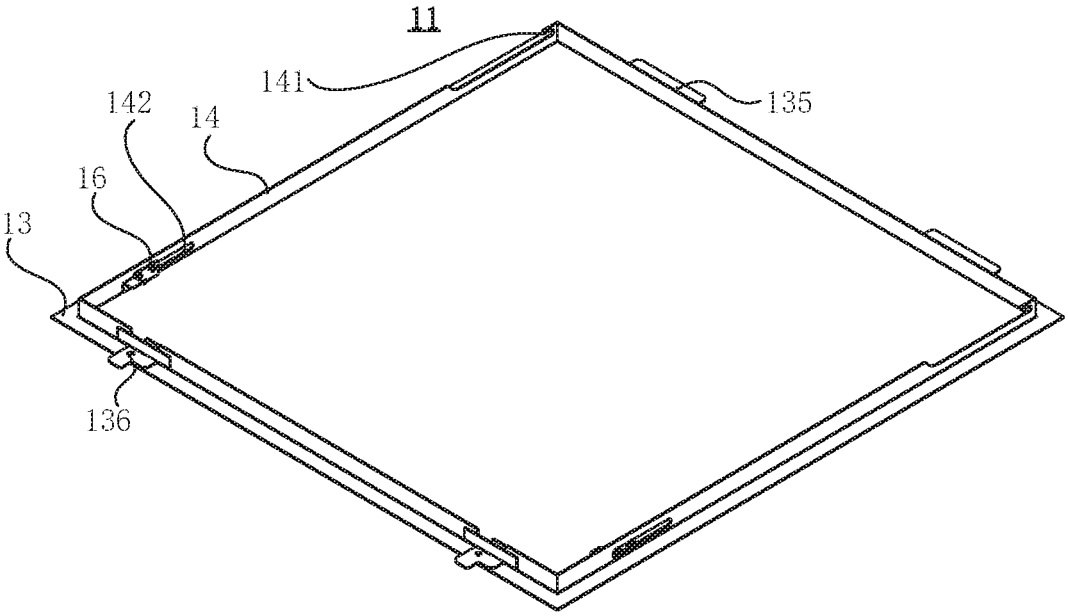
FIG. 7 is a structural schematic diagram of a back surface of the bracket of the lamp according to one embodiment of the present disclosure.
Figure 8:
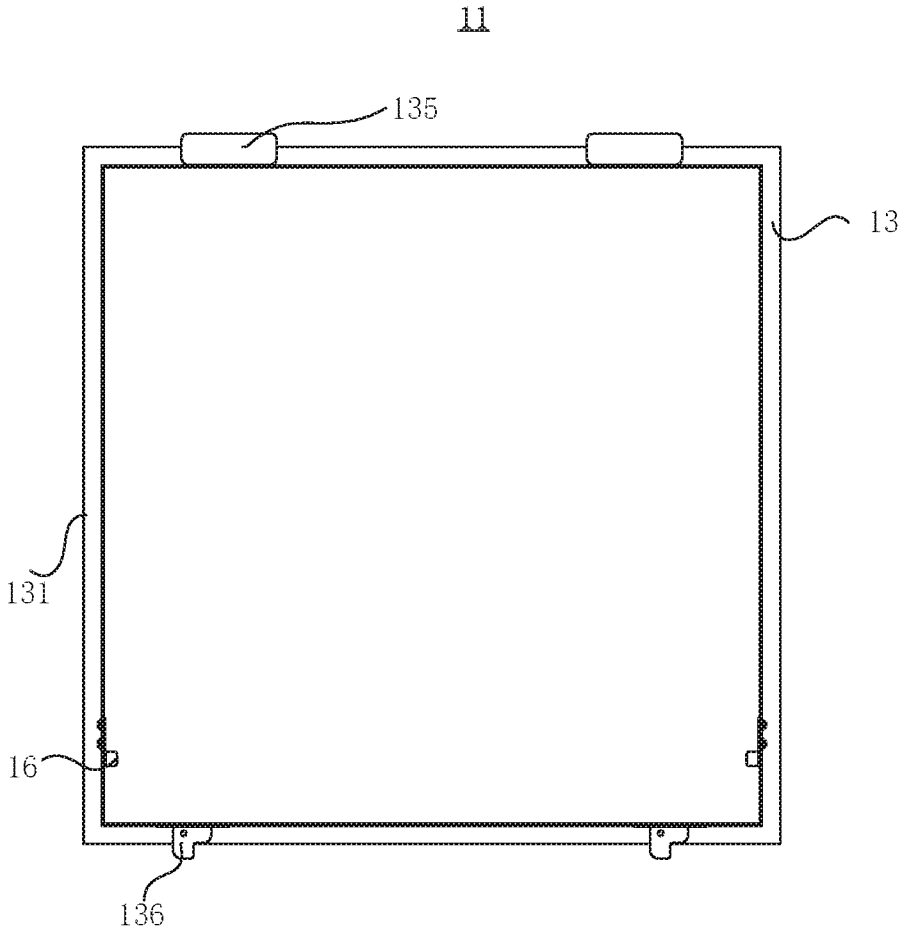
FIG. 8 is a plane schematic diagram of the back surface of the bracket of the lamp according to one embodiment of the present disclosure.
Figure 9:
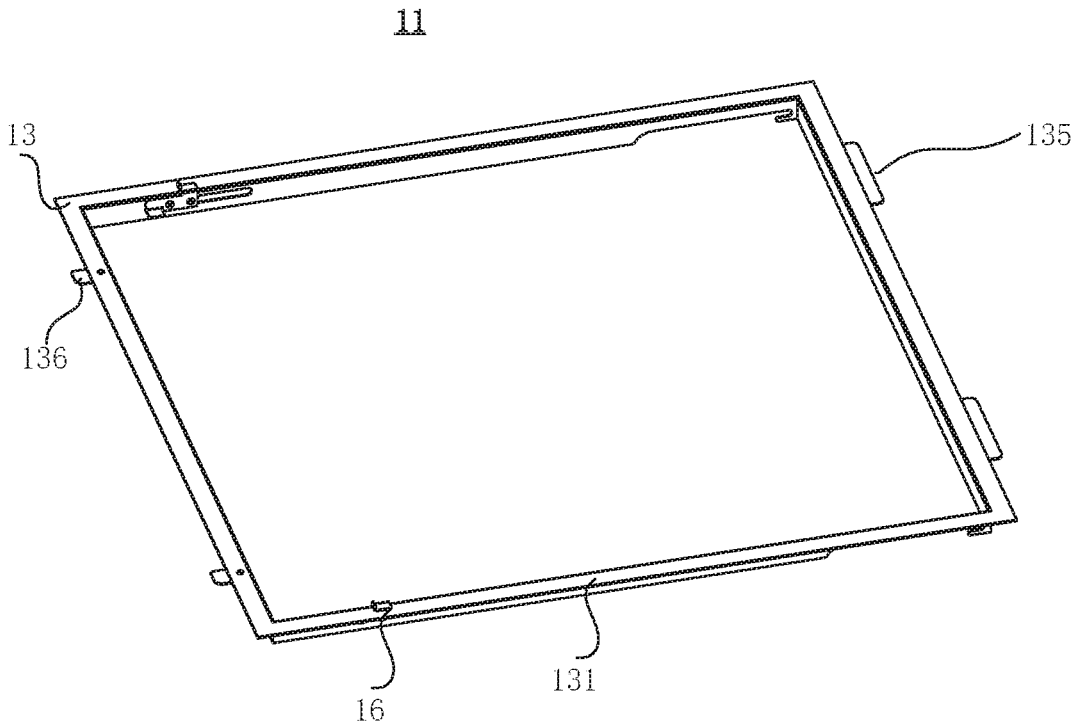
FIG. 9 is a structural schematic diagram of a front surface of the bracket of the lamp according to one embodiment of the present disclosure.

As shown in FIGS. 1-9, the present disclosure provides a lamp 10, including a bracket 11, a lamp body 12, and at least one locking assembly 16. The bracket 11 is enclosed to form an accommodation portion, the accommodation portion is configured to accommodate the lamp body 12. The lamp body 12 is an LED lamp body.

The bracket 11 includes a hollow plate 13. The hollow plate 13 includes a first flat plate 131 and a second flat plate 132, where the first flat plate 131 and the second flat plate 132 are symmetrically disposed. A first vertical plate 14 is convexly disposed on a surface of the first flat plate 131, and the first vertical plate 14 is connected with one side of the first flat plate 131 close to the second flat plate 132. Further, the first vertical plate 14 is perpendicular to the first flat plate 131. A second vertical plate 15 is convexly disposed on a surface of the second flat plate 132, and the second vertical plate 15 is connected with one side of the second flat plate 132 close to the first flat plate 131. The first vertical plate 14 and the second vertical plate 15 are oppositely disposed. Further, the second vertical plate 15 is perpendicular to the surface of the second flat plate 132. A first open groove 141 is disposed on the first vertical plate 14, and a second open groove 151 is disposed on the second vertical plate 15. A first clamping shaft 121 is disposed on one side of the lamp body 12, a second clamping shaft is disposed on another side of the lamp body 12. The first clamping shaft 121 is clamped into the first open groove 141 to be rotatably and detachably connected with the first vertical plate 14, the second clamping shaft is clamped into the second open groove 151 to be rotatably and detachably connected with the second vertical plate 15, so that the lamp body 12 is rotatably and detachably connected with the bracket 11. The locking assembly 16 limits the lamp body 12 to rotate relative to the bracket 11 when the lamp body 12 is rotated into the accommodation portion.

In one embodiment, a sliding groove 142 is disposed on the first vertical plate 14. The locking assembly 16 includes a folding plate 161, clamping tables 162, and a clamping support 164. The clamping tables 162 are convexly disposed on one side of the folding plate 161, and the clamping support 164 is convexly disposed on another side of the folding plate 161. Limiting portions 163 are respectively disposed on one end of each of the clamping tables 162 distal to the folding plate 161, the clamping tables 162 pass through the sliding groove 142 so that the locking assembly 16 slides along the sliding groove 142. The limiting portions 163 are configured to limit the clamping tables 162 to slide out of the sling groove 142. A cross-sectional area of each of the limiting portions 163 is greater than a cross-sectional area of each of the clamping tables 162. A third open groove 123 is disposed on one side of the lamp body 12. When the body lamp 12 rotates into the accommodation portion, the clamping support 164 slides into the third open groove 123 along a direction of the sliding groove 142 to limit the lamp body 12 to rotate relative to the bracket 11.

Certainly, the locking assembly 16 is selectively disposed on the second vertical plate 15 and is further configured to limit the lamp body 12 to rotate relative to the bracket 11. The locking assembly disposed on the second vertical plate 15 is symmetric with the locking assembly 16 disposed on the first vertical plate 14 in structure.

In one embodiment, the hollow plate 13 includes a third flat plate 133 and a fourth flat plate 134, where the third flat plate 133 and the fourth flat plate 134 are symmetrically disposed. The first flat plate 131, the third flat plate 133, the second flat plate 132, and the fourth flat plate 134 are connected end to end to form the hollow plate 13. A surface of the third flat plate 133 is connected with two connecting overlapping edges 135. One end of each of the two connecting overlapping edges 135 extends out of the third flat plate 133 in a direction of the third flat plate 133 distal from the fourth flat plate 134.

In one embodiment, two overlapping rotating sheets 136 are rotatably connected with a surface of the fourth flat plate 134, when the overlapping rotating sheets 136 rotate relative to the third flat plate 133 in a predetermined angle, one end of each of the overlapping rotating sheets 136 extends out of the fourth flat plate 134 in a direction of the fourth flat plate 134 distal from the third flat plate 133.

In one embodiment, the first open groove 141, the second open groove 151, and the third open groove 123 are U-shaped grooves. A width of the first open groove 141 is equal to a diameter of the first clamping shaft 121, and a width of the second open groove 151 is equal to a diameter of the second clamping shaft.

In one embodiment, an upper end limiting plate 165 is convexly disposed on a surface of the one side of the folding plate 161, and the upper end limiting plate 165 is attached to a surface of one side of the first flat plate 131 distal to the sliding groove 142.

In one embodiment, an upper end turning plate 166 is disposed on one side of the upper limiting plate 165, the upper end turning plate 166 is perpendicular to the first vertical plate 14, and an edge of the upper end turning plate is a curve. The edge of the upper end turning plate is curved so that users may prevent from being scratched when pressing the upper end turning plate 166 to push the locking assembly 16.

In one embodiment, at least two clamping tables 162 are disposed on the folding plate 161. The clamping tables 162 disposed on the folding plate 161 are disposed at intervals. An arrangement direction of the clamping tables 162 disposed on the folding plate 161 is same as an extending direction of the sliding groove 142. For example, there are two clamping tables 162 disposed on the folding plate 161.

In one embodiment, the limiting portions 163 are fixing bolts. Threaded holes are respectively disposed on one end of each of the clamping tables 162. The fixing bolts are screwed into the threaded holes to be connected with the clamping tables 162. Certainly, the limiting portions 163 are further connected with the clamping tables 162 in a snap-fit manner, etc.

In one embodiment, the clamping tables 162 are any one of a cylinder, a square column, and a prism.

In one embodiment, a control box 124 is disposed on one side of the lamp body 12 to control the lamp body 12. The control box 124 is connected with the lamp body 12 by a screw.

In one embodiment, the control box 124 includes a power supply, a control panel, etc. And the control box 124 is configured to supply power for the lamp body 12 and adjust brightness of the lamp body 12.

Please refer to FIGS. 1-9, a process of installing the convenient-to-replace lamp of the present disclosure into a rectangular keel frame in accordance with one embodiment briefly is described below.

The process of installation is as following.

Step 1: placing the entire bracket 11 on the rectangular keel frame; specifically, placing the two connecting overlapping edges 135 on one side of the rectangular keel frame; rotating the two overlapping rotating sheets 136 to draw the two overlapping rotating sheets 136 back to the fourth flat plate 134; and lifting the fourth flat plate 134 so that the bracket 11 is integrally embedded into the rectangular keel frame; rotating the two overlapping rotating sheets 136 to stretch the two overlapping rotating sheets 136 out with respect to the fourth flat plate 134, and then placing the two overlapping rotating sheets 136 on another side of the rectangular keel frame to place the entire bracket 11 on the rectangular keel frame.

Step 2: installing the lamp body 12 on the bracket 11; specifically, extending the lamp body 12 into the accommodation portion into the bracket 11 in an inclined posture relative to the bracket 11; clamping the first clamping shaft 121 of the lamp body 12 into the first open groove 141 of the bracket 11, and clamping the second clamping shaft of the lamp body 12 into the second open groove 151 of the bracket 11. At this time, the lamp body 12 rotates relative to the bracket 11; then rotating the lamp body 12 into the accommodation portion of the bracket 11; pushing locking assembly 16 disposed on the first vertical plate 14 along the sliding groove 142 to clamp the clamping support 164 of the locking assembly 16 into the third open groove 123; and limiting the lamp body 12 to rotate relative to the bracket 11 to install the lamp body 12 on the bracket 11.

An order of the first and second steps may be interchanged, and the present disclosure is not limited thereto.

The disassembly process is opposite to the installation process, and is not repeated here.

Compared with the prior art, the present disclosure provides the lamp, including the bracket, the lamp body, and the locking assembly. The bracket is enclosed to form the accommodation portion, the accommodation portion is configured to accommodate the lamp body. The bracket includes the hollow plate. The hollow plate includes the first flat plate and the second flat plate, where the first flat plate and the second flat plate are symmetrically disposed. The first vertical plate is convexly disposed on the surface of the first flat plate, and the first vertical plate is connected with one side of the first flat plate close to the second flat plate. The second vertical plate is convexly disposed on the surface of the second flat plate, and the second vertical plate is connected with one side of the second flat plate close to the first flat plate. The first vertical plate and the second vertical plate are oppositely disposed. The first open groove is disposed on the first vertical plate, and the second open groove is disposed on the second vertical plate. A first clamping shaft is disposed on one side of the lamp body, a second clamping shaft is disposed on another side of the lamp body. The first clamping shaft is clamped into the first open groove to be rotatably and detachably connected with the first vertical plate, the second clamping shaft is clamped into the second open groove to be rotatably and detachably connected with the second vertical plate, so that the lamp body is rotatably and detachably connected with the bracket. The locking assembly limits the lamp body to rotate relative to the bracket when the lamp body is rotated into the accommodation portion. The lamp includes the bracket and the lamp body, and the bracket and the lamp body are split-type. When the lamp body is replaced, the lamp body is detached from the bracket, the disassembly process of which is simple and convenient. Thus, the disassembly efficiency is improved and the maintenance cost is decreased.

The foregoing is merely one embodiment of the present disclosure and does not limit the scopes of the present disclosure. Any equivalent structure or equivalent process transformation, made according to the contents of the description and the drawings of the present disclosure, or directly or indirectly applied to other related technology fields, all fall within the scopes of the present disclosure.

What is claimed is:

1. A lamp, comprising:

a bracket;

a lamp body;

at least one locking assembly;

wherein the bracket is enclosed to form an accommodation portion, the accommodation portion is configured to accommodate the lamp body;

the bracket comprises a hollow plate; the hollow plate comprises a first flat plate and a second flat plate, where the first flat plate and the second flat plate are symmetrically disposed; a first vertical plate is perpendicularly disposed on a surface of the first flat plate, and the first vertical plate is connected with one side of the first flat plate close to the second flat plate; a second vertical plate is perpendicularly disposed on a surface of the second flat plate, and the second vertical plate is connected with one side of the second flat plate close to the first flat plate; the first vertical plate and the second vertical plate are oppositely disposed; a first open groove is disposed on the first vertical plate, and a second open groove is disposed on the second vertical plate; a first clamping shaft is disposed on one side of the lamp body, a second clamping shaft is disposed on another side of the lamp body; the first clamping shaft is clamped into the first open groove to be rotatably and detachably connected with the first vertical plate, the second clamping shaft is clamped into the second open groove to be rotatably and detachably connected with the second vertical plate, so that the lamp body is rotatably and detachably connected with the bracket; and the locking assembly limits the lamp body to rotate relative to the bracket when the lamp body is rotated into the accommodation portion;

wherein a sliding groove is disposed on the first vertical plate; the locking assembly comprises a folding plate, clamping tables, and a clamping support; the clamping tables are disposed on and protrude from one side of the folding plate, and the clamping support is disposed on and protrudes from another side of the folding plate; limiting portions are respectively disposed on one end of each of the clamping tables distal to the folding plate, the clamping tables pass through the sliding groove so that the locking assembly slides along the sliding groove; the limiting portions are configured to limit the clamping tables to slide out of the sliding groove; a third open groove is disposed on one side of the lamp body; when the lamp body rotates into the accommodation portion, the clamping support slides into the third open groove along a direction of the sliding groove to limit the lamp body to rotate relative to the bracket.

2. The lamp according to claim 1, wherein the hollow plate comprises a third flat plate and a fourth flat plate, where the third flat plate and the fourth flat plate are symmetrically disposed; the first flat plate, the third flat plate, the second flat plate, and the fourth flat plate are connected end to end to form the hollow plate; a surface of the third flat plate is connected with two connecting overlapping edges; one end of each of the two connecting overlapping edges extends out of the third flat plate in a direction of the third flat plate distal from the fourth flat plate; two overlapping rotating sheets are rotatably connected with a surface of the fourth flat plate, when the overlapping rotating sheets rotate relative to the fourth flat plate in a predetermined angle, one end of each of the overlapping rotating sheets extends out of the fourth flat plate in a direction of the fourth flat plate distal from the third flat plate.

3. The lamp according to claim 2, wherein the first open groove, the second open groove, and the third open groove are U-shaped grooves; a width of the first open groove is equal to a diameter of the first clamping shaft, and a width of the second open groove is equal to a diameter of the second clamping shaft.

4. The lamp according to claim 3, wherein an upper end limiting plate is disposed on and protrudes from a surface of the one side of the folding plate, and the upper end limiting plate is attached to a surface of one side of the first flat plate distal to the sliding groove.

5. The lamp according to claim 2, wherein an upper end limiting plate is disposed on and protrudes from a surface of the one side of the folding plate, and the upper end limiting plate is attached to a surface of one side of the first flat plate distal to the sliding groove.

6. The lamp according to claim 1, wherein an upper end limiting plate is disposed on and protrudes from a surface of the one side of the folding plate, and the upper end limiting plate is attached to a surface of one side of the first flat plate distal to the sliding groove.

7. The lamp according to claim 6, wherein an upper end turning plate is disposed on one side of the upper limiting plate, the upper end turning plate is perpendicular to the first vertical plate, and an edge of the upper end turning plate is a curve.

8. The lamp according to claim 7, wherein at least two clamping tables are disposed on the folding plate; the clamping tables disposed on the folding plate are disposed at intervals; an arrangement direction of the clamping tables disposed on the folding plate is same as an extending direction of the sliding groove.

9. The lamp according to claim 8, wherein the limiting portions are fixing bolts; threaded holes are respectively disposed on one end of each of the clamping tables; the fixing bolts are screwed into the threaded holes to be connected with the clamping tables.

10. The lamp according to claim 9, wherein the clamping tables are any one of a cylinder, a square column, and a prism.

11. The lamp according to claim 9, wherein a control box is disposed on one side of the lamp body to control the lamp body; the control box is connected with the lamp body by a screw.

* * * * *